United States Patent [19]

Schindele

[11] 3,930,384

[45] Jan. 6, 1976

[54] COMPOUND NEEDLE FOR CIRCULAR KNITTING MACHINE

[75] Inventor: Alfred Schindele, Harthausen, Germany

[73] Assignee: C. Terrot Sohne, Stuttgart, Germany

[22] Filed: Apr. 23, 1974

[21] Appl. No.: 463,666

[30] Foreign Application Priority Data

Apr. 25, 1973 Germany ..... 2320789

[52] U.S. Cl. ..... 66/50 R

[51] Int. Cl.[2] ..... D04B 15/78

[58] Field of Search ..... 66/13, 50 R, 123

[56] References Cited

UNITED STATES PATENTS

| | | | |
|---|---|---|---|
| 1,673,634 | 6/1928 | Page | 66/13 |
| 1,877,503 | 9/1932 | Gagne | 66/13 |
| 3,771,327 | 11/1973 | Engelfried | 66/50 R |

*Primary Examiner*—Louis K. Rimrodt

[57] ABSTRACT

Compound knitting needles are operatively mounted in a circular knitting machine and coact with a special simplified cam system.

Each of the compound needles has a butt-free hook part and a latch. The latch has a first butt and is shiftable relative to the hook part and the hook part has an abutment which drives the tongue part. A lifting element is articulated to the hook part. The lifting element has a second butt and is radially movable by selecting members between an operative and inoperative position. When the lifting element is in the operative position it moves the hook part articulated thereto in accordance with the cam system of the circular knitting machine.

4 Claims, 3 Drawing Figures

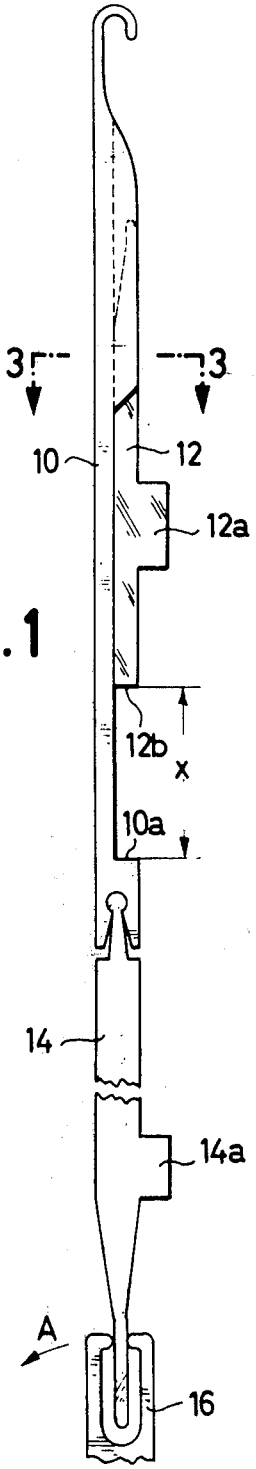
Fig. 1
Fig. 2
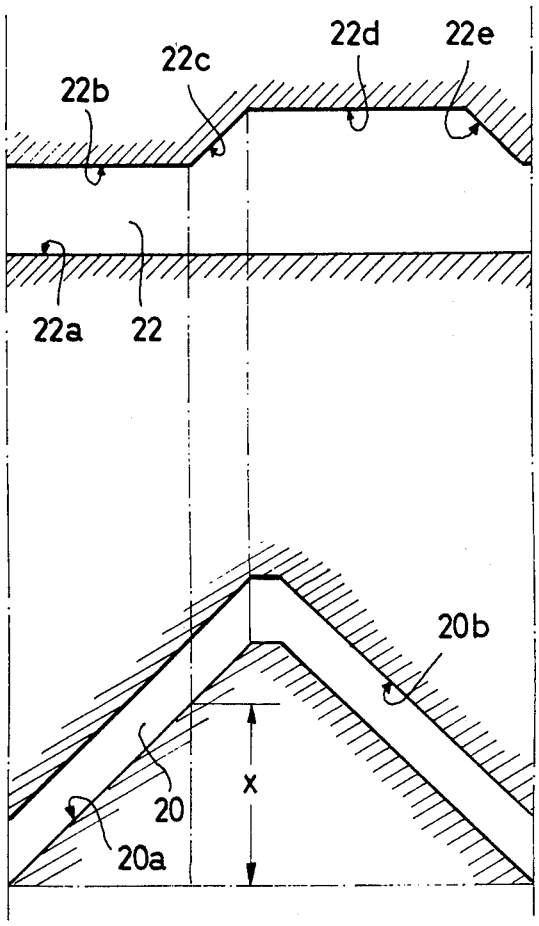
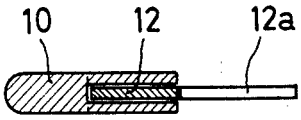
Fig. 3

COMPOUND NEEDLE FOR CIRCULAR KNITTING MACHINE

The invention relates to a knitting tool for circular knitting machines, and concerns a knitting tool comprising a compound needle and a lifting element.

A number of examples of compound needles are known, these compound needles comprising a hook part and a latch, which is longitudinally shiftable relative to the hook part. In the case of one known example both the hook part and the latch of the compound needle have a respective butt, each of these butts engaging in a respective cam track of an associated cam system, with the result that the hook part and latch are lifted independently of one another, and are then returned to their starting position. In the case of a second known example, only the hook part of the compound needle has a butt, and the cam system only has one cam track, in which this single butt engages. Stops are provided on the hook part of the needle for controlling the latch of the needle, these stops being so spaced from one another that, although the hook part can be moved relative to the latch, the hook part nevertheless drives the tongue part in both directions after a specific path of movement has been negotiated.

By reason of the smaller paths of ascending and descending (return) movement, the use of compound needles enables higher speeds to be realized and also enables a greater number of systems to be incorporated. It is, therefore, desirable, to employ these compound needles in circular knitting machines which are controlled according to a pattern in particular in Jacquard circular knitting machines.

Accordingly, compound needles for use in circular knitting machines are known, these needles being controllable according to a pattern as shown, e.g., in Czech Pat. No. 457,692 and German published application, No. 1,635,844. All the known compound needles of this type have a butt on the hook part and on the latch and it is necessary to provide, for both butts, cam tracks which have to be accurately manufactured and brought into exact mutual registration (alignment). Control exercised on the basis of a control pattern, is exercised in the one instance, by way of the butt of the latch of the needle — electromagnetically controlled guide (switching) members being installed in the cam track of this butt — and, in the second instance, by way of a selector (jack), which is radially pivotable and can in this way be caused to co-operate with one or both elements of the compound needle.

The invention has the object of providing a knitting tool comprising a compound needle and a lifting element which enables each individual needle to be selected on the basis of a pattern, although the cam parts can be manufactured more cheaply. A prior proposal for realizing this object, consists in a compound needle which comprises: a hook part, and a latch, which is longitudinally slidable relative to the hook part; a stop on the hook part for the latch, this stop lying, in the lower terminal position of the hook part, a pre-determined distance from that portion of the latch which co-operates with this stop, this distance being equal to a relative path of motion between hook part and latch; and a butt on the latch.

According to the invention there is provided a knitting tool for Jacquard circular knitting machines, which tool comprises a lifting element and a compound needle, with a butt-free hook part which can be lifted by the said lifting element, and with a latch which is longitudinally shiftable relative to the hook part, there being an abutment on the hook part for driving the tongue part, with a first butt on the latch and with a second butt, which is provided on the said lifting element and arranged in operation, to co-operate with a lifting cam surface, this lifting element being pivotable, radially as dictated by a pattern control system, between an operative and an inoperative position, the said lifting element being articulated to the hook part, and the abutment of the hook part, which is arranged to lift the latch of the needle, lying, when the hook part is in its lower terminal position, a pre-determined distance $x$ from that portion of the latch of the needle which co-operates with it.

Preferably the hook part has a recess which terminates, in its lower portion, in a shoulder, this recess receiving the latch of the needle; and the shoulder constitutes an abutment surface for the lower end of the latch.

According to the invention a compound needle of this type is so constructed that a control element, serving to lift the hook part, is associated, in a manner known per se, with this hook part, the control element having a butt for co-operating with a lifting cam surface, and the control element being radially pivotable between an operative and an inoperative position. According to a preferred embodiment of the compound needle according to the invention the control element is a jack, which is articulated to the hook part. Thus, the previously known compound needles either incorporated a single butt only and two stops, which are effective in both directions, or a butt on the hook part and another butt on the latch of the needle. In contradistinction to this, the compound needle according to the invention is a tripartite needle, this being known per se. However, the proposed needle only has two butts and does not require, for the butt of the latch, a cam track both of whose flanks have to be shaped with precision along their whole length. This latter-mentioned feature of the present invention will be further explained below.

The fact that the control element, which is provided with a butt and forms part of the proposed compound needle, which is composed of at least three pivotable parts, makes it possible to control the needle on the basis of a pattern. This control is exercised by pivoting the control element in the radial direction of the needle cylinder, so that either the butt of the control element is brought out of engagement with the lifting (clearing) cam track with which it is associated, or so that a control element, which is not articulated to the hook part of the compound needle, is brought into a position in which it moves past the hook part during the lifting (clearing) movement. The form of construction proposed according to the invention affords the further advantage that numerous known and simply constructed selector devices for circular knitting machines, which can be controlled according to a pattern, may be used for controlling the said control element; this is not true of the known compound needles which can be controlled according to a pattern (see in particular Czeck Pat. No. 457,692).

Although the compound needle according to the invention comprises two butts, nevertheless it permits the use of a cam system which is cheaper to manufacture than those cam systems which have hitherto been used for compound needles having two butts. Use is made of a cam system having two cam tracks for controlling the hook part and the latch of the compound needle. The first of these cam tracks, that is to say the track associated with the butt of the said control element, is to be provided with an ascending lifting (clearing) cam surface, and a descending return cam surface, whereas the second of these cam tracks, that is to say the track associated with the butt of the said latch, only has to be equipped with a needle return edge or surface. In the case of the known compound needles both cam tracks have to be manufactured with precision over their whole length. In contrast to this, in the case of a cam system for use with the compound needle according to the invention, only the needle return edge or surface of the cam track associated with the butt of the latch has to be manufactured with precision, because the stop on the hook part of the needle serves to lift the latch.

In principle uncontrolled bouncing movements of the latch of the needle could be prevented by providing a suitable frictional contact. However, in the case of a preferred embodiment of the cam system according to the invention, the second cam track, i.e., the track associated with the latch, has stop surfaces for the butt of the latch, the upper abutment edge of this cam track comprising: a first level portion, which extends, in the direction of movement of the compound needles, to a point above that point (of the lifting edge of the first cam track) at which the extent of the lifting or clearing action corresponds to the initial distance between the hook part and the latch of the needle; a second portion, which lies directly adjacent the first level portion of the upper abutment edge of this cam track, this second portion lying parallel to the lifting or clearing edge surface of the first cam track and terminating at the same point as this lifting edge of the first cam track; a third portion of the upper abutment edge surface, which extends as far as the descending (return) edge surface of the second cam track, both this said third portion of the upper abutment edge and also the lower abutment edge surface of this cam track being level, i.e., without ascent or descent, and the distance between the first portion of the upper abutment edge and the lower abutment edge is equal to the width of the butt of the latch of the needle. The first level (gradient-free) region of the upper abutment edge prevents the latch of the needle being driven, during the needle lifting or clearing action, by the hook part of the needle owing to frictional contact. The second portion of the upper abutment edge, this second portion lying parallel to the lifting or clearing edge of the first cam track, enables the latch of the needle to be lifted by the abutment surface of the hook part; and the third, level portion of the upper abutment edge determines or defines the upper terminal position of the latch. Finally, the lower abutment edge of the second cam track limits the extent to which the latch of the needle is driven, by fractional contact, by the hook part of the needle during the descending or return movement of the hook part.

Further features and details of the invention will be clear from the appended drawing, which represents a preferred embodiment of the compound needle and of a cam system for co-operation with this needle, reference being made to this drawing in the following description.

In the drawing:

FIG. 1 is a side view of a compound needle, the upper end of a forked selector jack also being shown, this forked selector jack belonging to a pattern control system which is known per se;

FIG. 2 is a view of a cam system for use with the invention, as viewed from the needle cylinder, and FIG. 3 is a cross-sectional view, taken along the line III—III in FIG. 1, through the compound needle.

The compound needle illustrated comprises a hook part 10, a tongue part 12, and a suspended or articulated jack 14. As is clear from FIG. 3, the hook part 10 of the compound needle is forked, the latch 12 being guided in the forked portion. The latch 12 has a butt 12*a*. The hook part 10 is so constructed, in its lower portion, that it is formed with a stop portion 10*a*, which co-operates with the lower end 12*b* of the latch 12, this stop portion 10*a* carrying the latch 12 with it when the hook part 10 has been upwardly pushed through a distance *x*.

The jack 14 is suspended in the lower portion of the hook part 10 of the compound needle, so that jack 14 is articulated, i.e., swivelably connected, to the hook part 10. The suspended or articulated jack 14 is formed with a butt 14*a*, and co-operates with a forked selector jack 16, which can be swivelled in the direction of the arrow A in response to a controlling action by a pattern control system.

The cam box illustrated in FIG. 2 has a first and a second cam track 20 and 22 respectively. In the position (condition) of the compound needle illustrated in FIG. 1, the butt 14*a* of the articulated jack 14 engages in the first cam track 20, while butt 12*a* of the latch 12 engages in the second cam track 22. The first cam track 20 has an ascending control surface 20*a* and a descending (return) control surface 20*b*. The second cam track 22 has a lower, level (without gradient) abutment surface 22*a*, an upper abutment edge 22*b* – 22*d*, and a descending or return control surface 22*e*, which lies immediately adjacent the upper abutment surface 22*b* – 22*d*. The latter-mentioned abutment surface 22*b* – 22*d* is composed of three regions, viz, a first surface 22*b*, which is level (i.e., without ascent or descent), a second, ascending surface 22*c*, and a third surface or portion 22*d*, which, again, is level. The distance of the first cam surface 22*b* from the lower abutment surface 22*a* corresponds to the width of the butt 12*a* of the latch 12 of the needle. The second cam surface 22*c* begins above that point of the ascending cam surface 20*a* of the first cam track 20 at which the hook part 10 of the needle has been raised through the height or distance *x*. The cam surface 22*c* is parallel to the ascending cam surface 20*a*. Finally, the descending or return cam surface 22*e* is parallel to the descending (return) cam surface 20*b*, and is so arranged and dimensioned that the latch 12 of the compound needle will re-assume its starting position simultaneously with the hook part 10 of the needle.

When the forked selector jack 16 is pivoted in the direction of arrow A, that is to say in the radial direction, by the pattern control system (not shown), the butt 14*a* is brought out of engagement with the first cam track 20, so that the compound needle associated with this particular forked selector jack 16 missknits. When, on the other hand, the forked selector jack 16 assumes the position shown in FIG. 1, then the needle associated with it will knit.

Conveniently, the descending or return cam surfaces 22*e* and 20*b* are constituted by one or more separate parts, in particular parts which can be shifted together for thus realising a desired depth of loop (stitch) formation. In accordance with a preferred embodiment two parts, constituting the descending or return cam surfaces 22*e* and 20*b*, are mounted on a common slide member, which is adjustably arranged in the cam box.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a pattern-controlled Jacquard-type circular knitting machine, a knitting arrangement including first and second cooperable cam tracks, a compound needle including a hook portion vertically movable between an uppermost and a lowermost position and a latch cooperable with the hook portion and normally situated in a first position, the latch having a first butt engageable in the first cam track, means for effecting engagement of the hook portion and the latch when the hook portion is raised through a predetermined vertical distance from its lowermost position so that further upward movement of the hook portion is accompanied by an upward movement of the latch from its first position, and a jack member articulated to the hook member and responsive to the pattern control means of the circular knitting machine for selectively operating the hook member, the jack member having a second butt in contact with the second cam track for effecting a prescribed movement of the first butt of the latch in the first cam track, the second cam track having ascending and descending cam surfaces, the first cam track having a first upper abutment surface coextensive with a portion of the descending cam surface of the second cam track for effecting a lowering of the latch into its first position.

2. The improved knitting machine as set forth in claim 1, wherein said hook part has well portions defining a recess, and said latch is slidably mounted in said recess, and the engagement effecting means comprises an upwardly facing abutment on the hook portion and a cooperating downwardly facing abutment on the latch, the cooperating abutments being separated by the predetermined distance when the hook portion is in its lowermost position.

3. The improved knitting arrangement as set forth in claim 1, wherein said first cam track further comprises a second substantially horizontal upper abutment surface which is coextensive with a first portion of said ascending cam surface that has a vertical component equal to the predetermined distance, a third upper abutment surface contiguous to said second abutment surface and parallel to said ascending cam surface and coextensively terminating therewith and a fourth substantially horizontal upper abutment surface interposed between said third abutment surface and said first abutment surface.

4. The improved knitting arrangement as set forth in claim 1, wherein said first abutment surface and said descending cam surface are rigidly connected to each other and are adjustable in the longitudinal direction of the compound needle.

* * * * *